US010034809B2

(12) United States Patent
Kimmerle et al.

(10) Patent No.: US 10,034,809 B2
(45) Date of Patent: Jul. 31, 2018

(54) BATH TUB LIFTER

(71) Applicant: Invacare International Sarl, Gland (CH)

(72) Inventors: Michael Kimmerle, Leutkirch (DE); Jurgen Zimmerle, Maierhofe (DE)

(73) Assignee: Invacare International Sarl, Gland (CH)

( * ) Notice: Subject to any disclaimer, the term of this patent is extended or adjusted under 35 U.S.C. 154(b) by 0 days.

(21) Appl. No.: 15/518,799

(22) PCT Filed: Oct. 9, 2015

(86) PCT No.: PCT/IB2015/057734
§ 371 (c)(1),
(2) Date: Apr. 13, 2017

(87) PCT Pub. No.: WO2016/059523
PCT Pub. Date: Apr. 21, 2016

(65) Prior Publication Data

US 2017/0231845 A1 Aug. 17, 2017

(30) Foreign Application Priority Data

Oct. 16, 2014 (DE) ..... 10 2014 115 040

(51) Int. Cl.

| | |
|---|---|
| ***A47K 3/02*** | (2006.01) |
| ***A61G 7/10*** | (2006.01) |
| ***A47K 3/12*** | (2006.01) |
| ***B66F 7/06*** | (2006.01) |

(52) U.S. Cl.
CPC ..... *A61G 7/1003* (2013.01); *A47K 3/122* (2013.01); *B66F 7/065* (2013.01)

(58) Field of Classification Search
CPC ..... A61G 9/006; A61G 7/1003
USPC ..... 4/144.1–144.3, 564.1
See application file for complete search history.

(56) References Cited

U.S. PATENT DOCUMENTS

2007/0083990 A1 4/2007 Werschmidt

FOREIGN PATENT DOCUMENTS

DE 102005048642 A1 5/2007
DE 202006012777 U1 12/2007

OTHER PUBLICATIONS

International Search Report and Written Opinion from PCT/IB2015/057734 dated Jan. 9, 2016.
International Preliminary Report on Patentability from PCT/IB2015/057734 dated Apr. 18, 2017.

*Primary Examiner* — Lori Baker
(74) *Attorney, Agent, or Firm* — Calfee, Halter & Griswold LLP

(57) ABSTRACT

A bath tub lifter, comprising a seat element (1), a lifting apparatus (4) for raising and lowering the seat element (1) between a lower operating end position and an upper operating end position, and a scissor lift arrangement (10) having two pairs of scissor lifts with scissor elements, wherein, in the operative state, respectively two scissor elements are coupled to each other such that they are mutually pivotable about a bearing axis.

20 Claims, 12 Drawing Sheets

BATH TUB LIFTER

RELATED APPLICATIONS

The present application is the U.S. national phase entry of PCT/IB2015/057734, filed on Oct. 9, 2015, which claims priority to German Application No. 102014115040.6, filed on Oct. 16, 2014 the entire disclosures of which are fully incorporated herein by reference.

TECHNICAL FIELD

The present invention relates to a bath tub lifter comprising a seat element which is raisable and lowerable by means of a scissor lift.

BACKGROUND OF THE INVENTION

Bath tub lifters of the type in question serve to transfer care-dependent persons, for instance old or handicapped persons, gently into a bath tub and to lift them out of this same. A bath tub lifter of this type is disclosed, for instance, in DE 10 2006 048 524 A1. In this known bath tub lifter, for the raising and lowering of the seat element, two pairs of scissor legs, which can be raised up and spread by means of a lifting apparatus, are coupled to one another. The coupling is realized by means of diverse elements such as coupling parts, connecting parts and locking parts. This is labor-intensive and cost-intensive.

A further, comparable bath tub lifter is known from DE 10 2005 048 642 A1. DE 20 2006 012 777 U1 shows a, in this respect, comparable lifting apparatus in the form of a scissor-type lifting table.

From the trade, a product of Invacare GmbH, which is marketed under the brand name ORCA (registered trademark) and in which, advantageously, instead of a multiplicity of individual scissor components, two scissor frames, an inner scissor frame and an outer scissor frame, are provided, is known. In the course of the assembly, these two scissor frames are fitted one into the other so that, on the outer scissor frame, inwardly extending pins can be inserted into corresponding bores in the inner scissor frame and, in conjunction with bearing bushes, ensure a stable mounting, wherein an axial locking is effected by additional locking elements.

SUMMARY OF THE INVENTION

The object, and thus the technical problem, on which the present invention is based is to provide a bath tub lifter of the type in question which is light and functional, enables a particularly economical production, and at the same time ensures the necessary operating reliability.

This object is achieved by a bath tub lifter according to patent claim 1. Advantageous embodiments of the invention according to patent claim 1 are defined in the subclaims.

The bath tub lifter according to the invention comprises a seat element and a lifting apparatus for raising and lowering the seat element between a lower operating end position and an upper operating end position, and a scissor lift arrangement having two pairs of scissor lifts with scissor elements, wherein, in the operative state, respectively two scissor elements are coupled to each other such that they are mutually pivotable about a bearing axis. On an inner scissor element a bearing inner element, and on an outer scissor element a bearing outer element, is provided. The bearing is constructed such that the bearing inner element and the bearing outer element, when the inner scissor element and the outer scissor element are in an assembly angular position relative to each other, can be joined in the radial direction into a functional setting, in which the bearing inner element and the bearing outer element are oriented coaxially to the bearing axis. The scissor elements in the operative state, over an operating range between the lower operating end position and the upper operating end position, do not assume the assembly angular position relative to each other, so that a separation in the radial direction is prevented throughout the operating range by form closure.

The radial joining ensures that a bending-up of scissor elements in the course of the assembly, as is necessary with an assembly in the axial direction, is no longer necessary. The scissor elements can therefore be made more rigid, and nevertheless lighter, by the choice of appropriate shaping and materials. As a result of the radial assembly, the bearings can be made wider, moreover, so that the bearing forces can be handled even without additional bearing bushes. This enables a lesser number of parts. Moreover, the design of the bearings such that the scissor elements in the operative state, over an operating range between the lower operating end position and the upper operating end position, do not assume the assembly angular position relative to each other, so that separation in the radial direction is prevented throughout the operating range by form closure, enables that no additional locking elements, such as circlips or locking pins or the like, have to be used. The bath tub lifter according to the invention is therefore light and functional, enables a particularly economical production, and at the same time ensures the necessary operating reliability.

In one embodiment of the invention, the bearing outer element is configured with a bearing sleeve having a bearing seat, arranged concentrically to the bearing axis, and two radial recesses of different tangential width, wherein the tangential width of the first recess corresponds to the diameter of the bearing seat, and the tangential width of the second recess is smaller than the tangential width of the first recess, and the bearing inner element is configured with a bearing journal, the outer diameter of which corresponds to the diameter of the bearing seat and which has at least one, preferably two, stop cams, which, when the inner scissor element and the outer scissor element are in an assembly angular position relative to each other, can pass through the second recess and, when the scissor elements in the operative state do not assume the assembly angular position relative to each other, prevent the separation in the radial direction by form closure.

The bearing outer element can be configured with a journal arranged concentrically to the bearing axis, which journal is divided by a journal groove into two opposite journal segments, wherein the width of the journal groove corresponds to the width of the stop cam.

The bearing outer element can additionally be configured with a locking cam, which extends from the bearing seat radially in the direction of the bearing axis, wherein the bearing journal has a turned groove, in which the locking cam engages when the bearing outer element and the bearing inner element are arranged coaxially to each other.

The two outer scissor elements can respectively have a bearing outer element, and the two inner scissor elements a bearing inner element. The two outer scissor elements can additionally be combined to form an outer frame, the two inner scissor elements to form an inner frame. The inner frame can have at least one cross strut, which connects the two inner scissor elements and which prevents expansion and compression of the inner frame. Thus the inner frame can have, for instance, a cross strut in the region of the bearing axis, which cross strut connects the two inner scissor elements. The outer frame can have stiffening corners, which likewise prevent expansion of the outer frame.

The scissor elements, and the bearing inner elements and bearing outer elements configured in one piece with said scissor elements, can be produced from plastic in an injection molding process.

All the above-described embodiments, taken in isolation and in respective combinations, enable a particularly economical production and at the same time ensure the necessary operating reliability of a bath tub lifter which is light and functional.

BRIEF DESCRIPTION OF THE DRAWINGS

The invention is further explained below on the basis of illustrative embodiments with reference to the drawings, in which.

DETAILED DESCRIPTION

Figure 1:
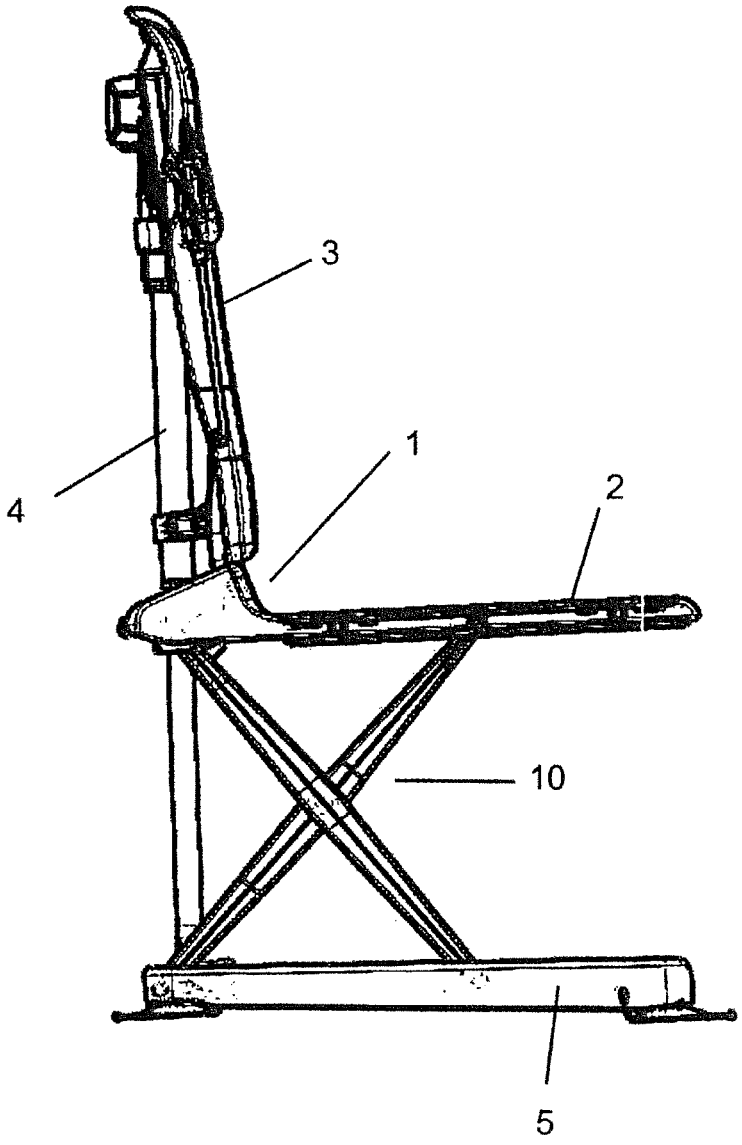
FIG. 1 is a view of one embodiment of a bath tub lifter according to the invention.

FIG. 1 shows a bath tub lifter according to one embodiment of the invention. A seat element 1 having a seat part 2 and a backrest 3 can be raised and lowered by means of a lifting apparatus 4 in conjunction with a scissor lift arrangement 10. The lifting apparatus 4 and the scissor lift arrangement 10 are supported on a base plate 5, which can be placed, for instance, onto the bottom of a bath tub (not shown). By raising and lowering of the seat element 1, a care-dependent person can be transferred gently into a bath tub and lifted out of this same.

Figure 2:
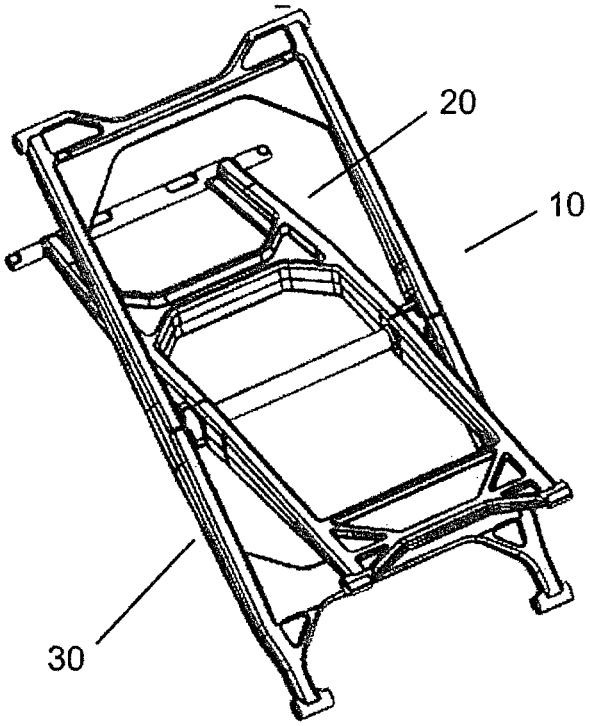
FIG. 2 is a perspective representation of a scissor lift arrangement.

A perspective view of the scissor lift arrangement 10 is shown in FIG. 2. The scissor lift arrangement 10 has an inner frame 20 and an outer frame 30.

Figure 3:
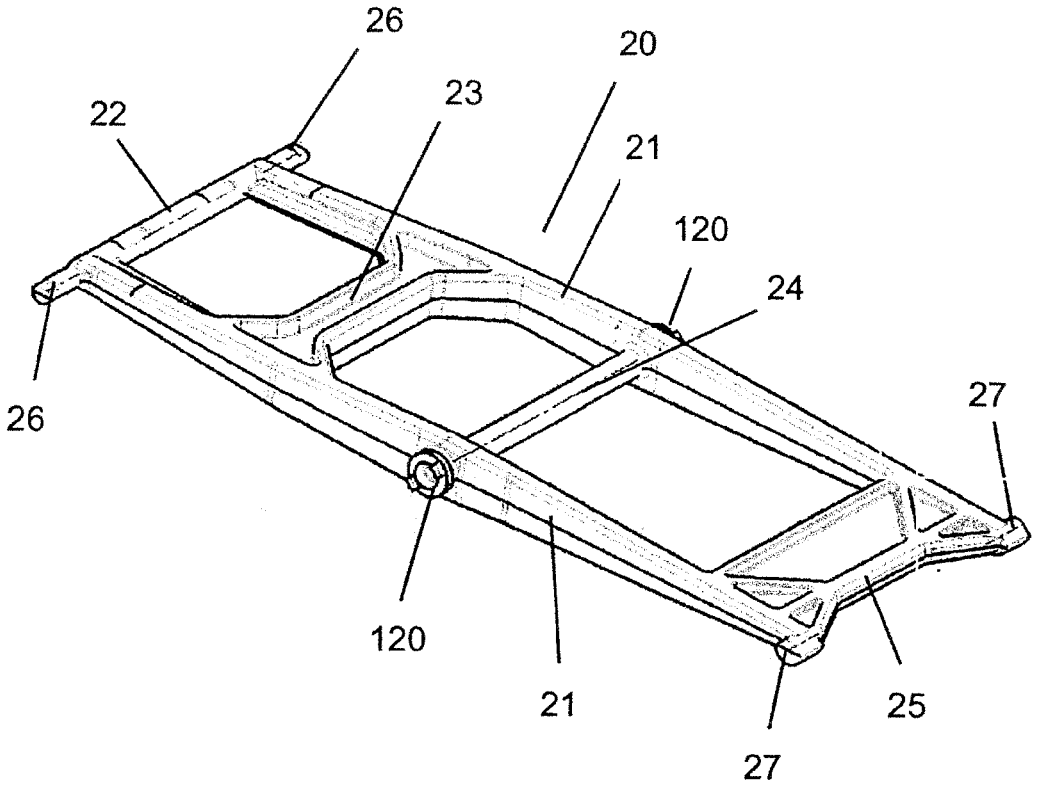
FIG. 3 is a perspective representation of an inner frame of the scissor lift arrangement according to FIG. 2.
Figure 4:
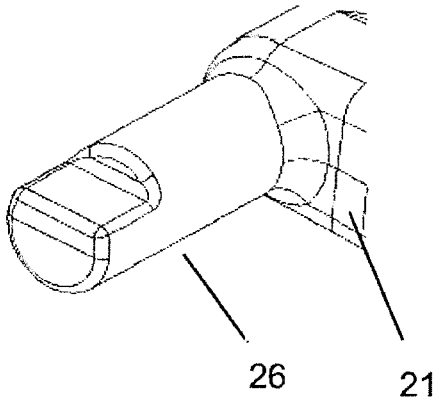
FIG. 4 shows a rear bearing of the inner frame according to FIG. 3.
Figure 5:
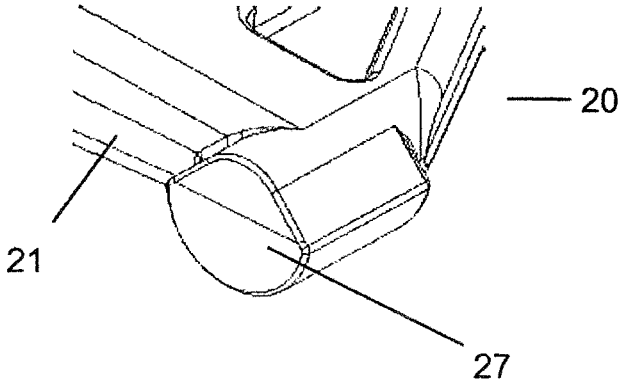
FIG. 5 shows a front sliding element of the inner frame according to FIG. 3.

FIG. 3 shows the inner frame 20 comprising two inner scissor elements 21 and two bearing inner elements 120, which latter are respectively arranged on the, related to the inner frame 20, outward facing sides of the inner scissor elements 21. In the shown illustrative embodiment, the two inner scissor elements 21 are connected by, all in all, four transverse members 22, 23, 24 and 25, such that the inner frame 20 is stably formed. The transverse member 24 is in this case realized as a cross strut in the region of the bearing axis.

The inner frame 20, and thus the two inner scissor elements 21, are connected via rear bearings 26 to the base plate 5. The corresponding connection to the seat part 2 of the seat element 1 is realized via sliding elements 27.

Figure 7:
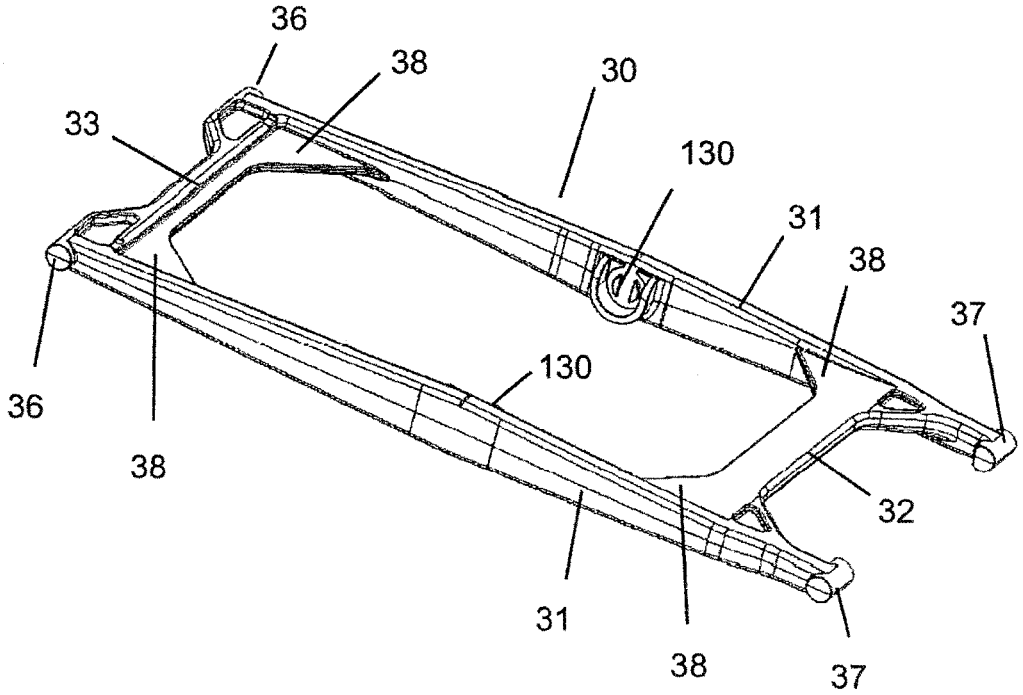
FIG. 7 shows an outer frame of the scissor lift arrangement according to FIG. 2.
Figure 8:
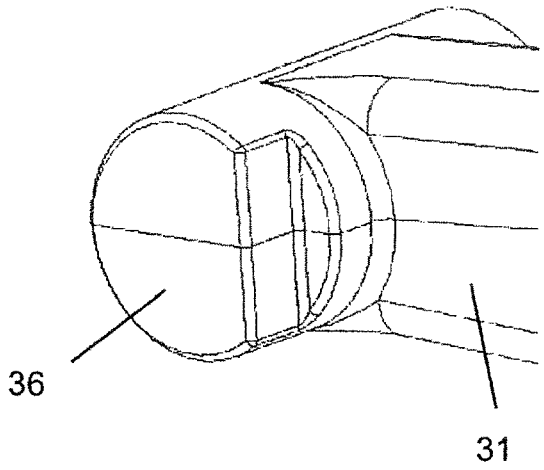
FIG. 8 shows a rear bearing of the outer frame according to FIG. 7.

FIG. 7 shows in a perspective view the outer frame 30 comprising two outer scissor elements 31, which are connected by transverse members 32 and 33 such that the outer frame 30 is stably formed. The transverse members 32 and 33 are reinforced by stiffening corners 38. The outer frame 30 likewise possesses two rear bearings 36, which are connected to the seat part 2 of the seat element 1, and sliding elements 37, which are connected to the base plate 5. On the inward facing sides of the outer scissor elements 31, that is to say pointing toward the inner side of the outer frame 30, are arranged outer bearing elements 130.

FIG. 1 shows the bath tub lifter, and thus also the scissor lift arrangement 10, in an upper operating end position, that is to say the position in which the seat element 1, in the operably mounted state of the bath tub lifter, assumes the maximum possible height.

Figure 13:
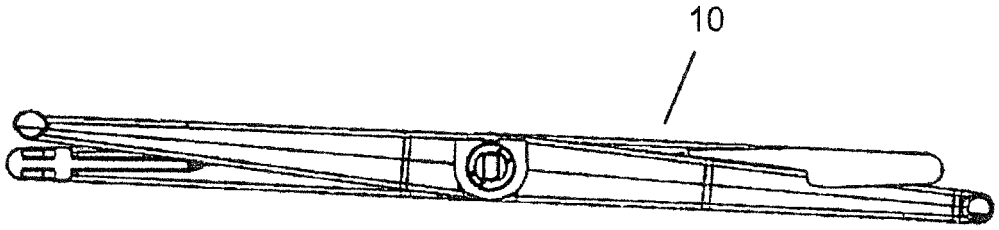
FIG. 13 shows the scissor lift arrangement according to FIG. 2 and FIG. 10 in a lower operating end position.

FIG. 13 shows the scissor lift arrangement 10 in a lower operating end position, that is to say the position which the scissor lift arrangement 10 assumes when the seat element 1 (not shown in FIG. 13), in the operably mounted state of the bath tub lifter, assumes the lowest height.

The mounting of the scissor lift arrangement 10 is described below, which mounting enables the inner frame 20 and the outer frame 30, and thus the two pairs of scissor lifts comprising the respective scissor elements in the form of, in each case, an inner scissor element 21 and an outer scissor element 31, to be mutually pivotable about a bearing axis. The relevant bearing elements, that is to say the bearing inner elements 120 disposed on the outer side of the inner frame 20 on the inner scissor elements 21 and the bearing outer elements 130 disposed on the inner side of the outer frame 30 on the outer scissor elements 31, are arranged concentrically to the bearing axis and couple the inner scissor elements 21 and outer scissor elements 31, and thus the inner frame 20 and the outer frame 30.

Figure 9:
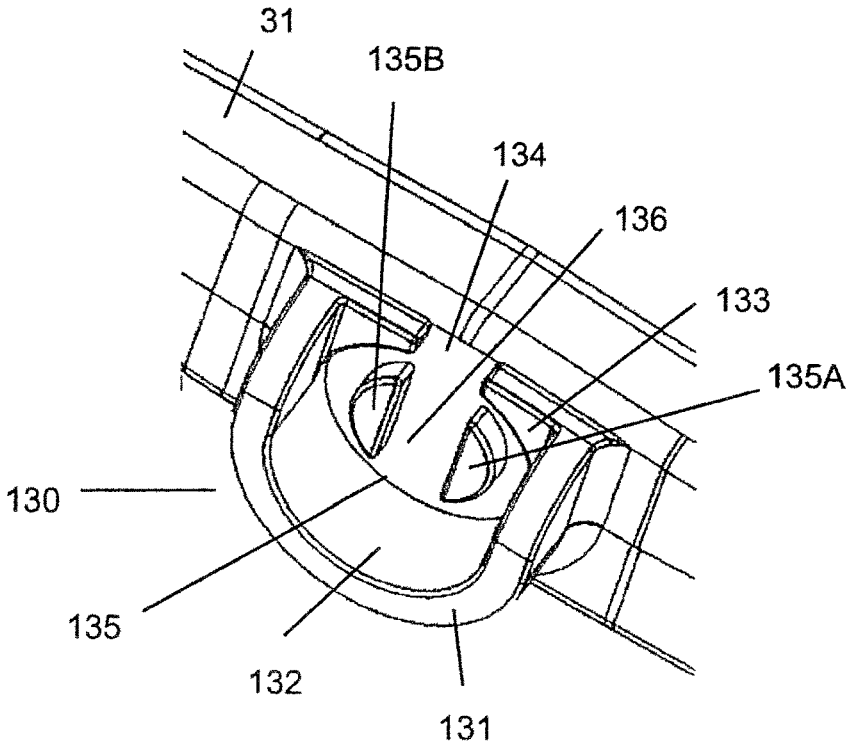
FIG. 9 shows a bearing outer element which is arranged on the outer frame according to FIG. 7.

As can be seen in particular from FIG. 9, the bearing outer element 130 is configured with a bearing sleeve 131 comprising a bearing seat 132, arranged concentrically to the bearing axis, and two radial recesses 133, 134 of different tangential width, wherein the tangential width of the first recess 133 corresponds to the diameter of the bearing seat 132 and the tangential width of the second recess 134 is smaller than the tangential width of the first recess 133. In the shown illustrative embodiment, the axial dimension of the second recess 134 is moreover smaller than that of the first recess 133.

Figure 6:
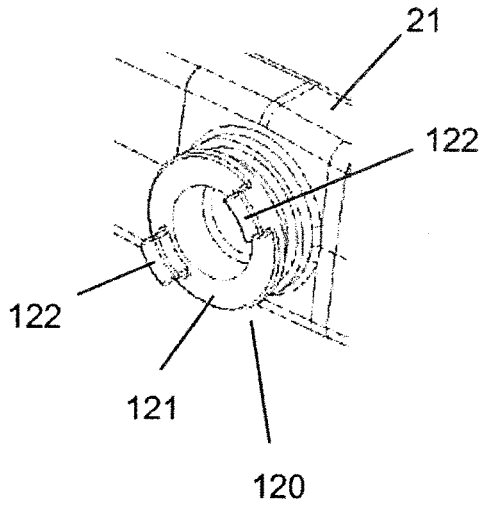
FIG. 6 shows a bearing inner element which is provided on the inner frame according to FIG. 3.
Figure 10:
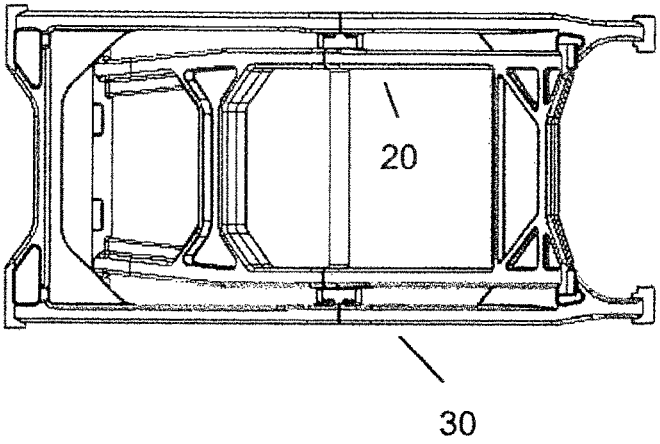
FIG. 10 shows the scissor lift arrangement according to FIG. 2 with the outer frame according to FIG. 7 and the inner frame according to FIG. 3 in an assembly angular position.
Figure 11:
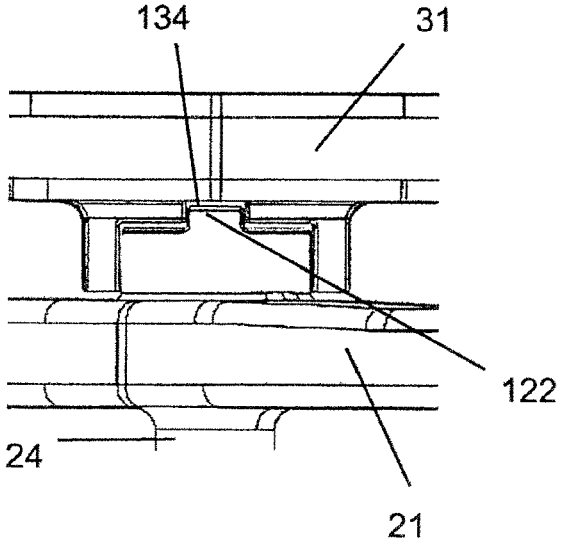
FIG. 11 shows, as an enlarged detailed view from FIG. 10, the bearing inner element and the bearing outer element in the assembly angular position in a radial view.
Figure 12:
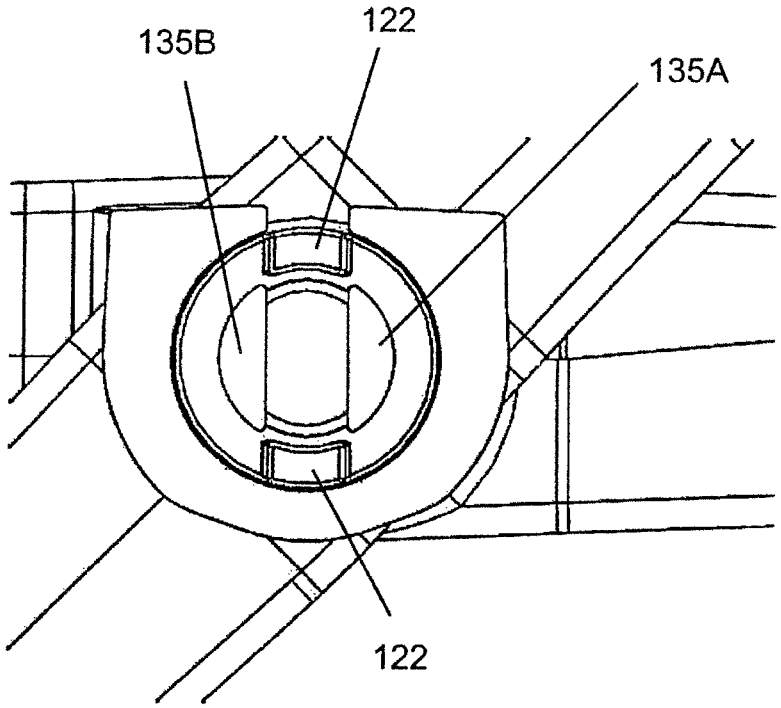
FIG. 12 is a representation according to FIG. 11 in axial view.
Figure 14:
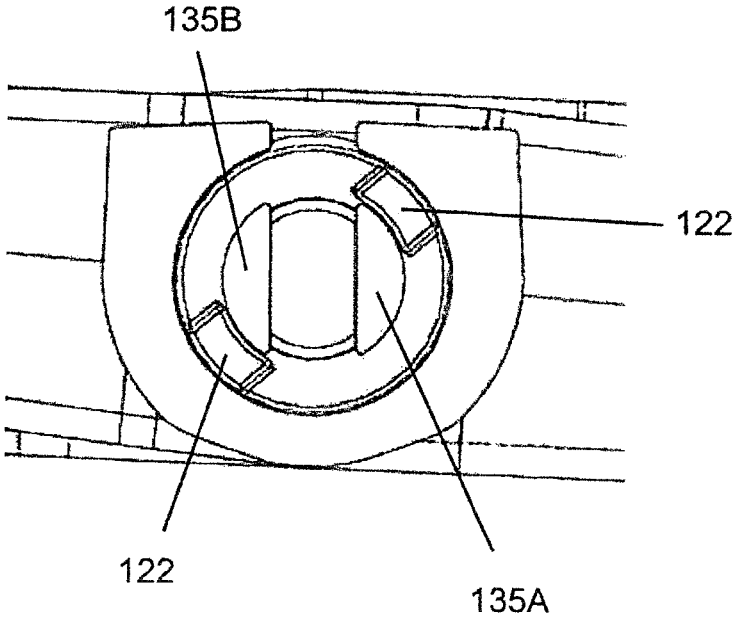
FIG. 14 shows a representation, corresponding to FIG. 12, of the bearing inner element and bearing outer element in the lower operating end position according to FIG. 13.

As can be seen in particular from FIG. 6, the bearing inner element 120 is configured with a bearing journal 121, the outer diameter of which corresponds to the diameter of the bearing seat 132 and which has two stop cams 122, which, when the inner scissor element 21 and the outer scissor element 31, and thus the inner frame 20 and the outer frame 30, are in an assembly angular position shown in FIG. 10, can pass through the second recess, as can be seen in particular from FIG. 11 and FIG. 12, and, when the scissor elements 21, 31 in the operative state do not assume the assembly angular position relative to each other, prevent the separation in the radial direction by form closure, as can be seen in particular from FIG. 14. The projection which in the region of the smaller, second recess 134 of the bearing outer element 130 is configured opposite the bearing seat 132 locks the stop cams 122 in an angular position, different from the assembly angular position, between inner frame 20 and outer frame 30 such that the bearing journal 121 of the bearing inner element 120 in such an angular position, that is to say a different position than the assembly angular position, cannot exit the bearing outer element 130 in the radial direction, due to form closure.

The bearing outer element 130 is configured with a journal 135 arranged concentrically to the bearing axis, which journal is divided by a journal groove 136 into two opposite journal segments 135A, 135B. The width of the journal groove 136 corresponds to the width of the stop cam 122. The journal segments 135A, 135B thus serve, on the one hand, to guide the stop cams 122 as the bearing inner element 120 and the bearing outer element 130 are radially joined together when the inner scissor element 21 and the outer scissor element 31, and thus the inner frame 20 and the outer frame 30, are in the assembly angular position (shown in FIG. 10) relative to each other, and also help to ensure that, when the inner scissor element 21 and the outer scissor element 31, and thus the inner frame 20 and the outer frame 30, are not in the assembly angular position (shown in FIG. 10) relative to each other, the bearing journal 121 of the bearing inner element 120 cannot exit the bearing outer element 130 in the radial direction, due to form closure.

Of course, in addition to the above-described embodiment in which both form closure variants are realized, selectively only one of the two described, or a different form closure variant evident to the person skilled in the art, can also be used.

As described, said form closure prevents the bearing journal 121 of the bearing inner element 120, when the inner scissor element 21 and the outer scissor element 31, and thus the inner frame 20 and the outer frame 30, are not in the assembly angular position (shown in FIG. 10) relative to each other, from being able to exit from the bearing outer element 130 in the radial direction.

In the above-described embodiment of the invention, an axial exiting of the bearing journal 121 of the bearing inner element 120 from the bearing outer element 130 is prevented by virtue of the fact that the inner frame 20 and the outer frame 30 are constructed such that they are appropriately resistant to deformation. This rigidity is in any case necessary, given the load bearing function of the scissor lift arrangement 10. In the above-described illustrative embodiment, the rigidity is achieved by a suitable choice of material and dimensioning of the inner scissor elements 21 and transverse members 22, 23, 24 and 25 of the inner frame 20, inclusive of the cross strut 24 in the region of the bearing axis, and of the outer scissor elements 31 of the outer frame 30, with the transverse members 32 and 33 reinforced by stiffening corners 38. To the person skilled in the art, it will be obvious that various modifications hereto are possible.

Figure 15:
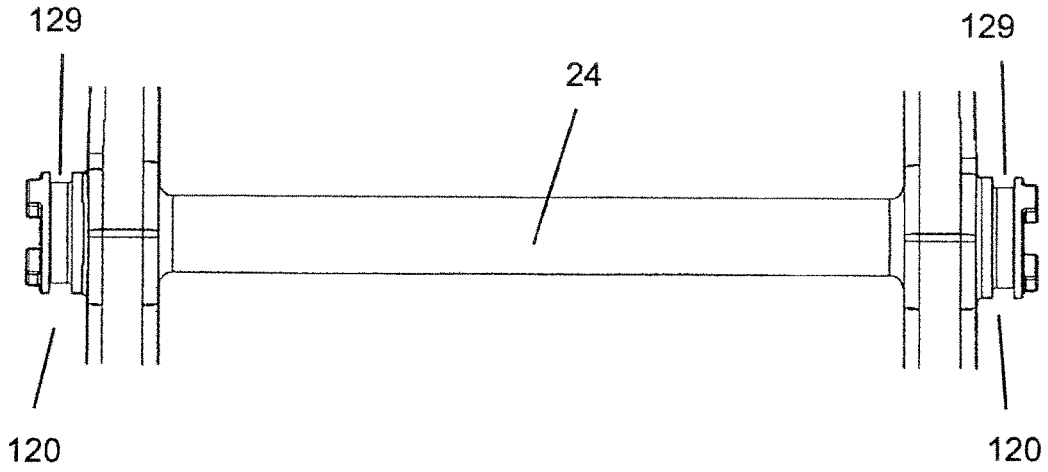
FIG. 15 shows a second embodiment of a bearing inner element.
Figure 16:
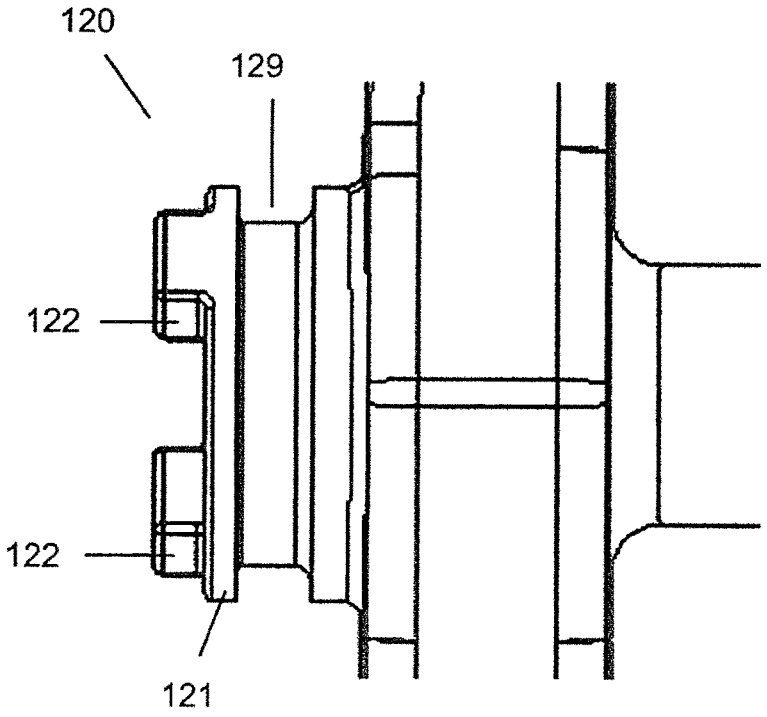
FIG. 16 is an enlarged representation of the bearing inner element according to FIG. 15.
Figure 17:
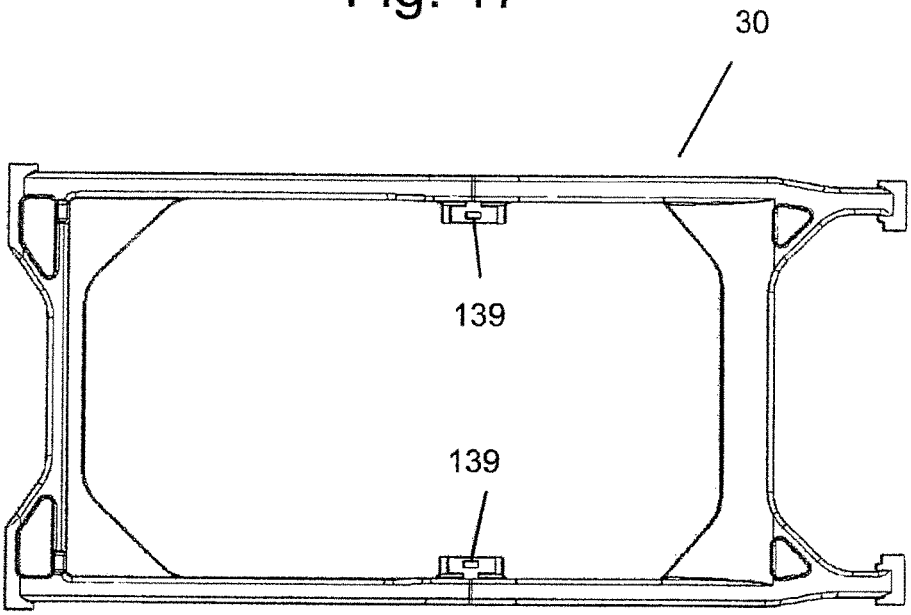
FIG. 17 shows a top view of an outer frame with a second embodiment of bearing outer elements, which is compatible with the second embodiment of the bearing inner elements according to FIG. 15 and FIG. 16.
Figure 18:
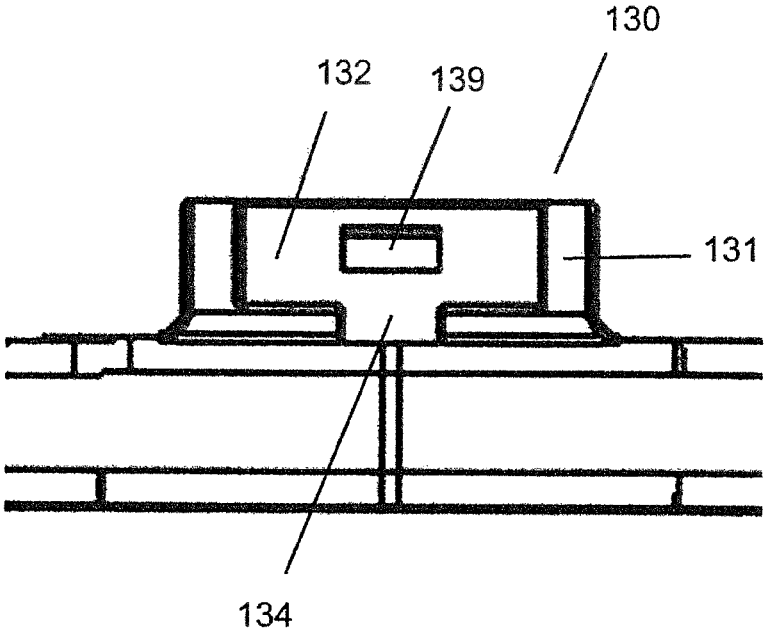
FIG. 18 is an enlarged representation of the bearing outer element according to FIG. 17.
Figure 19:
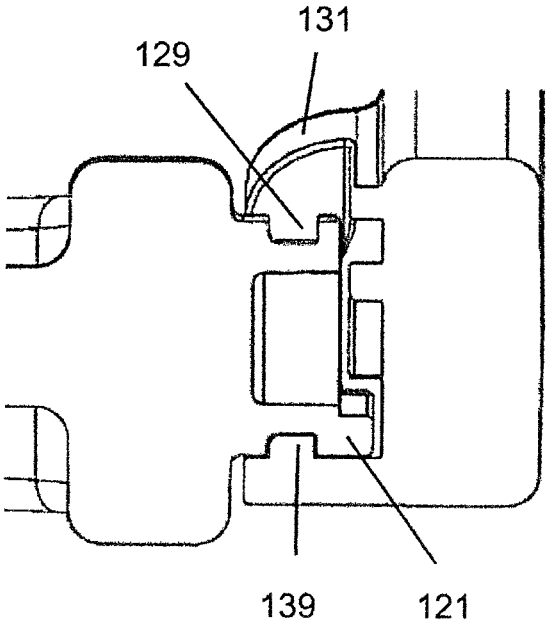
FIG. 19 is a schematic representation for illustrating the functional relationship between the second embodiment of the bearing inner element and the second embodiment of the bearing outer element.

In addition hereto, the bearing outer element can also be configured such that a form closure is formed in the axial direction also. To this end, the bearing seat 132 of the bearing outer element 130 can have, for instance, a locking cam 139, which extends from the bearing seat 132 radially in the direction of the bearing axis (see FIGS. 17 to 19), and the bearing journal 121 of the bearing inner element 120 can have a corresponding turned groove 129 (see FIGS. 15 and 16), in which the locking cam 139 engages if the bearing outer element 130 and the bearing inner element 120 are arranged coaxially to each other (see FIG. 19).

The invention claimed is:

1. A bath tub lifter, comprising a seat element, a lifting apparatus for raising and lowering the seat element between a lower operating end position and an upper operating end position, and a scissor lift arrangement having two pairs of scissor lifts each comprising an inner scissor element and an outer scissor element, wherein, in an operative state, the inner and outer scissor elements are coupled to each other such that they are mutually pivotable about a bearing axis, wherein the inner scissor element comprises a bearing inner element, wherein the outer scissor element comprises a bearing outer element, wherein the bearing inner element and the bearing outer element are configured such that, when the inner scissor element and the outer scissor element are in an assembly angular position relative to each other, said bearing inner and outer elements can be joined in a radial direction into a functional setting, in which the bearing inner element and the bearing outer element are oriented coaxially to the bearing axis, and wherein the bearing inner element and the bearing outer element are further configured such that, in the operative state, when the inner scissor element and the outer scissor element are in an angular position relative to each other that differs from the assembly angular position, the inner and outer scissor elements cannot be separated in the radial direction due to form closure over an operating range between the lower operating end position and the upper operating end position.

2. The bath tub lifter as claimed in claim 1, wherein the bearing outer element is configured with a bearing sleeve having a bearing seat, arranged concentrically to the bearing axis, and first and second radial recesses of different tangential width, wherein the tangential width of the first recess corresponds to a diameter of the bearing seat, and the tangential width of the second recess is smaller than the tangential width of the first recess, wherein the bearing inner element is configured with a bearing journal, an outer diameter of which corresponds to the diameter of the bearing seat and which has at least one stop cam, wherein, when the inner scissor element and the outer scissor element are in the assembly angular position relative to each other, the at least one stop cam can pass through the second recess and wherein, throughout the operating range, when the inner and outer scissor elements are in an angular position relative to each other that differs from the assembly angular position the at least one stop cam cannot exit through the second recess due to form closure.

3. The bath tub lifter as claimed in claim 2, wherein the bearing outer element is configured with a journal arranged concentrically to the bearing axis, wherein the journal is divided by a journal groove into two opposite journal segments, and the width of the journal groove corresponds to the width of the at least one stop cam.

4. The bath tub lifter as claimed in claim 2, wherein the bearing outer element is configured with a locking cam, which extends from the bearing seat radially in the direction of the bearing axis, and wherein the bearing journal has a turned groove, in which the locking cam engages when the bearing outer element and the bearing inner element are arranged coaxially to each other.

5. The bath tub lifter as claimed in claim 1, wherein the two outer scissor elements each have a bearing outer element, and the two inner scissor elements each have a bearing inner element.

6. The bath tub lifter as claimed in claim 1, wherein the two outer scissor elements are combined to form an outer frame, and the two inner scissor elements are combined to form an inner frame.

7. The bath tub lifter as claimed in claim 6, wherein the inner frame has at least one cross strut, which connects the two inner scissor elements.

8. The bath tub lifter as claimed in claim 7, wherein the cross strut is located in the region of the bearing axis.

9. The bath tub lifter as claimed in claim 6, wherein the outer frame has stiffening corners.

10. The bath tub lifter as claimed in claim 1, wherein the bearing inner element is configured in one piece with said inner scissor element, wherein the bearing outer element is configured in one piece with said outer scissor element, and wherein the inner and outer scissor elements are made from injection-molded plastic.

11. The bath tub lifter as claimed in claim 2, wherein the bearing journal has two stop cams.

12. The bath tub lifter as claimed in claim 3, wherein the bearing outer element is configured with a locking cam, which extends from the bearing seat radially in the direction of the bearing axis, and wherein the bearing journal has a turned groove, in which the locking cam engages when the bearing outer element and the bearing inner element are arranged coaxially to each other.

13. The bath tub lifter as claimed in claim 2, wherein the two outer scissor elements each have a bearing outer element, and the two inner scissor elements each have a bearing inner element.

14. The bath tub lifter as claimed in claim 3, wherein the two outer scissor elements each have a bearing outer element, and the two inner scissor elements each have a bearing inner element.

15. The bath tub lifter as claimed in claim 4, wherein the two outer scissor elements each have a bearing outer element, and the two inner scissor elements each have a bearing inner element.

16. The bath tub lifter as claimed in claim 2, wherein the two outer scissor elements are combined to form an outer frame, and the two inner scissor elements are combined to form an inner frame.

17. The bath tub lifter as claimed in claim 3, wherein the two outer scissor elements are combined to form an outer frame, and the two inner scissor elements are combined to form an inner frame.

18. The bath tub lifter as claimed in claim 4, wherein the two outer scissor elements are combined to form an outer frame, and the two inner scissor elements are combined to form an inner frame.

19. The bath tub lifter as claimed in claim 5, wherein the two outer scissor elements are combined to form an outer frame, and the two inner scissor elements are combined to form an inner frame.

20. The bath tub lifter as claimed in claim 7, wherein the outer frame has stiffening corners.

* * * * *